US005507128A

United States Patent [19]

Johnson et al.

[11] Patent Number: 5,507,128

[45] Date of Patent: Apr. 16, 1996

[54] TRAY BLANK MAGAZINE AND INFEED FOR PACKAGING MACHINE

[75] Inventors: Lloyd D. Johnson; Daniel J. Scroggin, both of Portland, Conn.

[73] Assignee: Standard-Knapp, Inc., Portland, Conn.

[21] Appl. No.: 337,627

[22] Filed: Nov. 10, 1994

[51] Int. Cl.[6] ..... B65B 21/00

[52] U.S. Cl. ..... 53/48.1; 53/389.1; 271/277

[58] Field of Search ..... 53/48.1, 48.6, 53/48.7, 48.8, 389.1; 271/277

[56] References Cited

U.S. PATENT DOCUMENTS

| | | | |
|---|---|---|---|
| 2,998,685 | 9/1961 | Ganz | 53/48.7 |
| 3,381,452 | 5/1968 | Gentry et al. | 53/48.1 |
| 3,619,966 | 11/1971 | Goldsberry | 53/389.1 |
| 4,887,414 | 12/1989 | Arena | 53/48.7 |
| 5,148,654 | 9/1992 | Kisters | 53/48.7 |

FOREIGN PATENT DOCUMENTS

| | | | |
|---|---|---|---|
| 0176949 | 9/1985 | European Pat. Off. | 53/48.8 |

*Primary Examiner*—Lowell A. Larson
*Assistant Examiner*—Gene Kim
*Attorney, Agent, or Firm*—McCormick, Paulding & Huber

[57] ABSTRACT

Tandem magazines store tray blanks of different size for loading product in different pack patterns. Each magazine has a depending cam device that engages unique lugs on the tray conveyor to allow the lowermost blank to be received on the tray conveyor, and then to be gripped by the unique lug for transport downstream toward the load station. Since only one magazine is used at one time these cam devices can be deactivated as desired. One of the two blank withdrawing means associated with each magazine is located under the tray blank conveyor and operates in timed relationship with it. The blank withdrawing means are also selectively deactivated for the same reason.

3 Claims, 6 Drawing Sheets

| FIG. 5A | FIG. 5B |
|---|---|

TRAY BLANK MAGAZINE AND INFEED FOR PACKAGING MACHINE

BACKGROUND OF THE INVENTION

The present invention relates to packaging machines of the type adapted to handle product fed continuously in a downstream direction through the machine, and to mate individual tray blanks with groups of product at a load station. More specifically, the present invention relates to a unique double magazine provided over the path of the tray blanks as they move on the infeed conveyor downstream toward the load station.

DESCRIPTION OF THE PRIOR ART

Packaging machines of the type adapted to pack product in trays or the like generally require readjustment and refilling of the magazine when a change over in product is encountered. That is, with differently sized trays the magazine must be readjusted to accommodate tray blanks of different size.

In present day high speed machines where the tray blanks are accelerated abruptly upon leaving the magazine conventional lug conveyors of the type commonly used in tray packaging machines generally suffer from the disadvantage that the tray blank may not be captured by the infeed conveyor for movement downstream toward the load station. The resulting machine shutdowns between production runs can be time consuming and lead to inefficient use of personnel and equipment.

SUMMARY OF THE INVENTION

The general purpose of the present invention is to provide a double magazine for storing blanks of at least two different sizes. Only one of the magazines is functional during any particular production run. However, quick change over is provided for by reason of the fact that minor manipulations are required to change over from one magazine to another, both magazines being provided in position immediately above the tray blank infeed conveyor.

Another object of the present invention is to provide the tray blank infeed conveyor immediately below these tray blank magazines, and to provide the mechanism for withdrawing the lowermost blank in a vertical stack between parallel conveyor runs associated with the lugs that move the tray blank downstream toward the load station. The present invention has as a still further object capturing the blank as it is received by the infeed conveyor with a unique lug system that cooperates with the magazine itself to grip or pinch the tray blank for controlled movement downstream on the infeed conveyor.

These objects are accomplished with the present invention by providing a packaging machine with at least one tray blank magazine for storing a plurality of tray blanks in a vertical stack, and providing immediately below the blank magazine a tray blank infeed conveyor comprising side-by-side parallel lug conveyors. Blank withdrawing means moves upwardly between these lug conveyors for withdrawing the lowermost blank from the bottom of the stack in the magazine and depositing this blank on the tray blank infeed conveyor. The blank engaging lugs on the conveyor each include a base secured to the conveyor and a blank pinching or gripping portion that is movably mounted on the base. The blank magazine frame includes a depending cam device for moving the blank pinching portion of the lug into an inactive position as the lug travels below the magazine so that the blank can be deposited on the infeed conveyor. Immediately thereafter the moveable portion of the lug moves into it's active position and pinches the blank so that the blank can be controlled in its movement downstream toward a load station, where groups of product are packaged on the tray blank in accordance with conventional practice. These cam devices can be selectively shifted to one side for the magazine not then in use.

BRIEF DESCRIPTION OF THE DRAWINGS

A more complete understanding of the invention and many of the attendant advantages thereto will be readily appreciated as the same becomes better understood by reference to the following detailed description when considered in conjunction with the accompanying drawings wherein.

DETAILED DESCRIPTION OF THE PREFERRED EMBODIMENT

Figure 1:
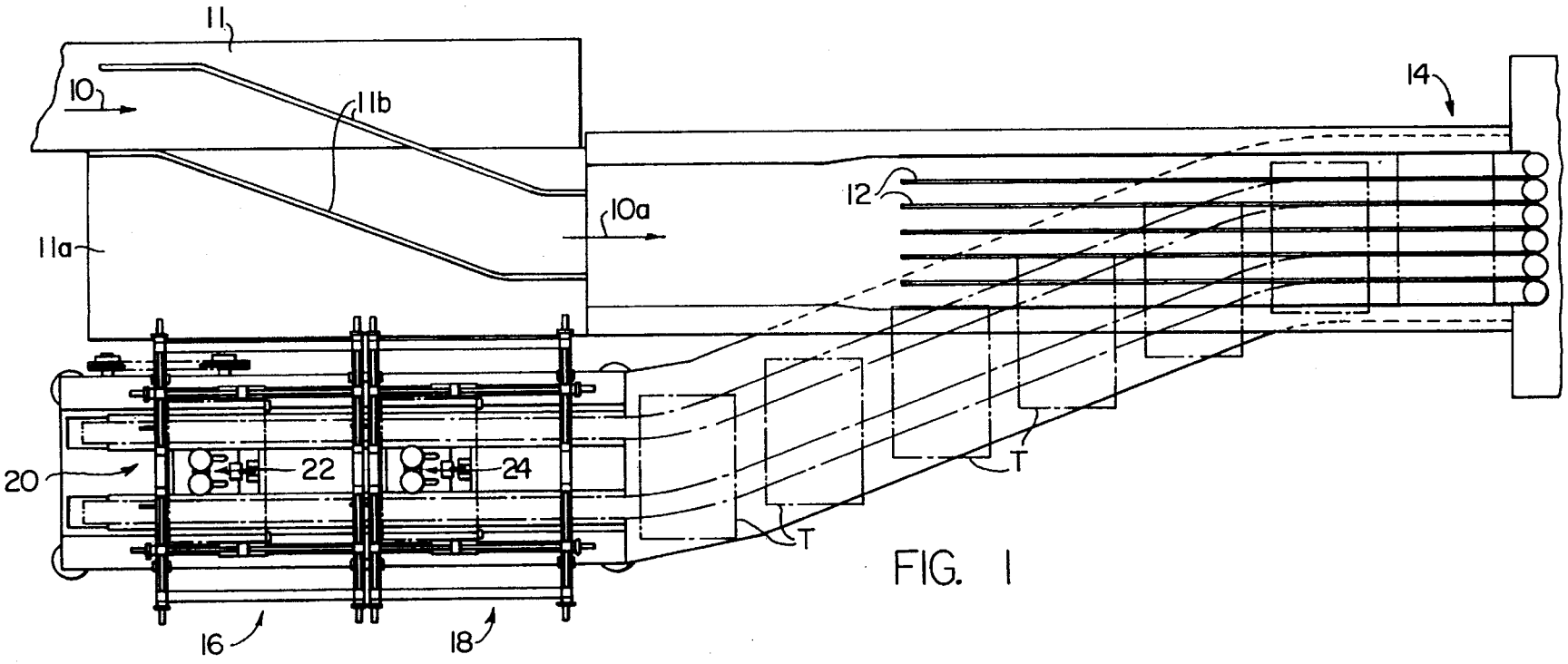
FIG. 1 is a top plan view of a double magazine and tray blank infeed conveyor in the environment of a packaging machine incorporating the present invention.

Turning now to the drawings in greater detail, FIG. 1 shows an upstream portion of a continuous motion packaging machine wherein product groups are packaged in paper board trays as a result of moving the product along a path indicated generally by the arrows 10 and $\mathbf{10}_a$ so that the articles in this case bottles or cans are provided between lane guides 12,12 so as to be arranged in columns as they proceed into the load station indicated generally at 14 in FIG. 1. Means is provided for segregating the columns of articles into a predetermined group or pack pattern dictated by the size of the tray blank bottom panel. The tray blank is generally planer in configuration when moving through this portion of the machine, but ultimately has side and end flaps that are folded upwardly and glued with the result that the product group forms a mandrel around which this folding can occur. After folding the product and its folded tray or usually fit into a shrink film tunnel or the like to complete the packaging process.

Still with reference to FIG. 1, at least one and preferably two or tandem tray blank magazines are provided as indicated generally at 16 and 18 in FIG. 1. A tray blank infeed conveyor 20 has an upper run located below these magazines and generally adjacent the bottom of the stack of blanks provided in the magazine. Means is provided for withdrawing the lower most blank from the bottom of the stack and pulling the tray blank downwardly into the path of the blank infeed conveyor. Such means is indicated generally at 22 in FIG. 1 for the first magazine 16. A similar mechanism is indicated generally at 24 and is associated with the second magazine 18 for the same purpose.

The blanks from one of the two magazines are withdrawn from the stack so as to be received on the tray blank magazine 20 and transported seriatim along the arcuately configured portion of the tray blank conveyor shown in FIG. 1 so that each tray blank in turn passes through the load station 14 referred to previously.

Figure 2:
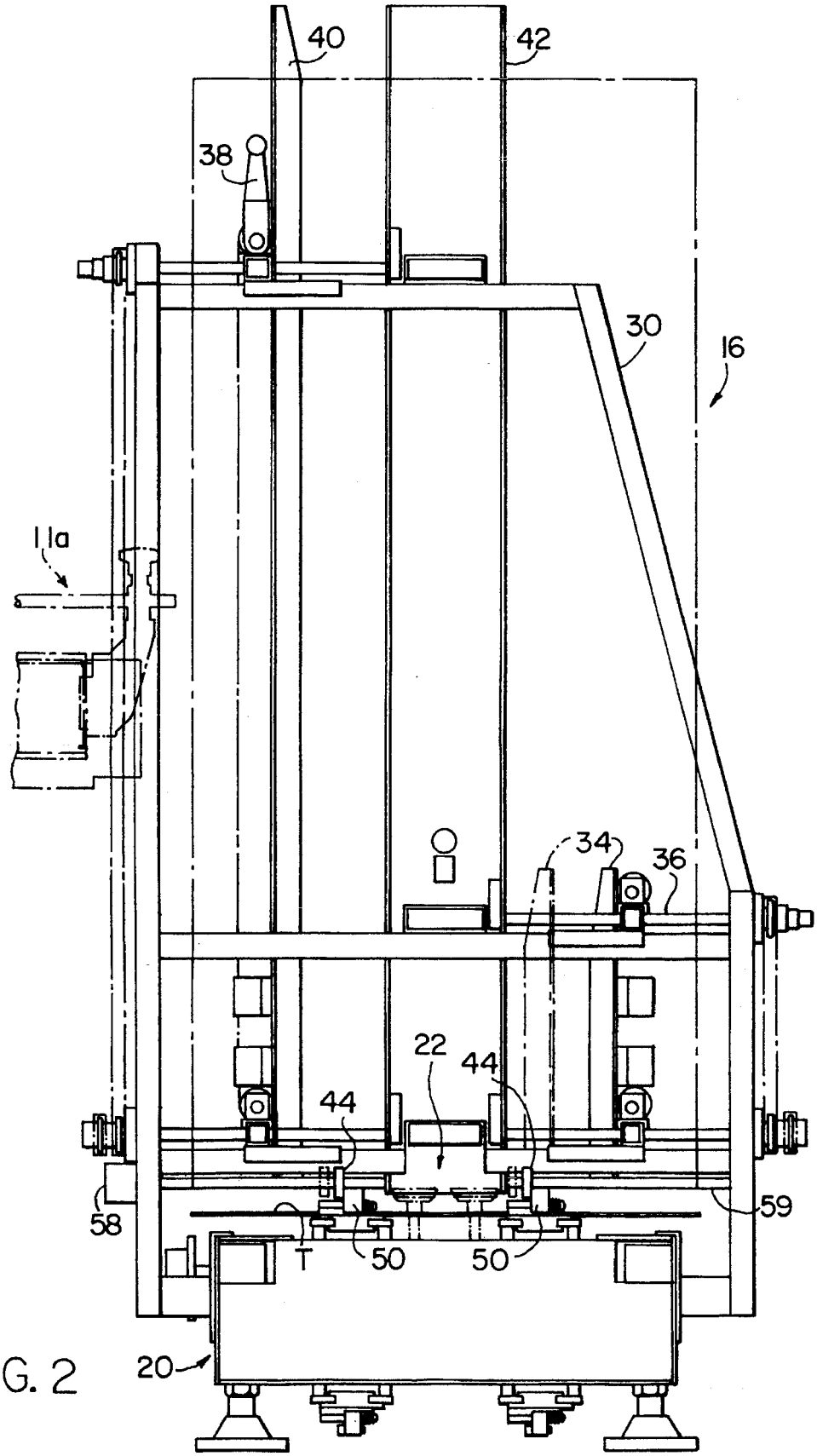
FIG. 2 is an end view thereof.

FIG. 2 illustrates the location for the article infeed conveyor $\mathbf{11}_a$ which receives articles from the conveyor 11 as a result of the diverting side guides $\mathbf{11}_b$ which move the articles from the first conveyor to the article infeed conveyor $\mathbf{11}_a$ where the articles accumulate for ultimate entry between the lane guides 12,12 referred to previously.

Still with reference to FIG. 2, the tray blank magazine 16 includes a frame 30 secured to a fixed base associated with the support for the tray blank conveyor 20. As shown in FIGS. 2 and 5 the frame 30 is mounted in spaced relationship to a second frame 32 comprising the upstream and downstream ends of the magazine respectively. The magazine itself is of generally conventional construction having a lower portion adapted to support a predetermined number of tray blanks, and having an upper portion adapted to store additional tray blanks such that the tray blanks can be released to afford a limited stack of blanks in the lower portion of the magazine where they can be conveniently withdrawn sequentially for purposes of being received by the tray blank conveyor to be described. With particular reference to FIG. 2, the upright stanchions 34 associated with the lower part of the magazine are adjustable in position for accommodating tray blanks of different size. An elite screw 36 is adapted to be fitted with a hand crank (not shown) for adjusting this stanchion 34. A second hand crank 38 associated with a larger stanchion 40 of the magazine 16 has a pair of associated lead screws for moving this upright larger stanchion 40 from the position shown other positions again to accommodate tray blanks of different size. A center fixed stanchion 42 associated with the magazine 16 is secured to the fixed frame 30 to provide side guides for the tray blanks in the magazine 16. FIG. 2 shows a tray blank T received on the tray blank conveyor 20 and more particularly provided adjacent the lugs on the tray blank conveyor in position for movement by the parallel chains associated with this tray blank conveyor. FIG. 4C shows the tray blank T held in position by one of these lugs 50 on one of the chains 52 of the tray blank conveyor 20.

Figure 4B:
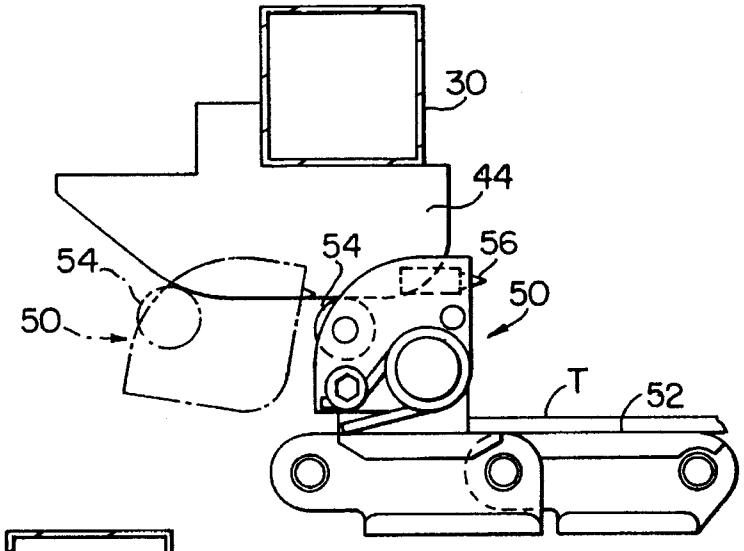
FIG. 4B is a view similar to FIG. 4A but taken at a slightly lighter instant of time.
Figure 4C:
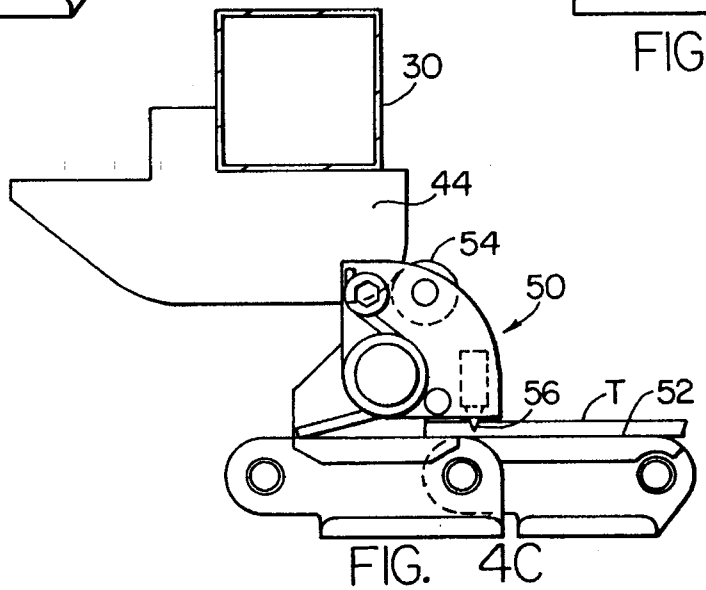
FIG. 4C is a view similar to FIGS. 4A and 4B showing the apparatus at a still later instant of time with the tray blank gripped for transport by its conveyor.
Figure 4A:
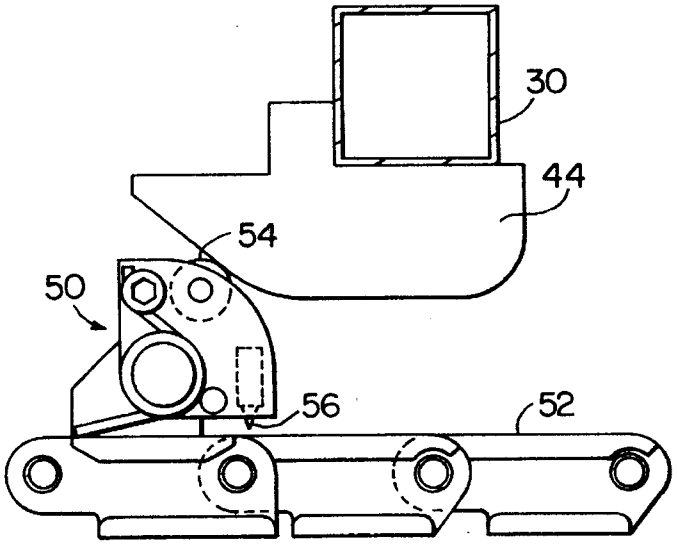
FIG. 4A is a detailed view of one lug approaching the camming device provided on the bottom of the magazine frame.
Figures 5, 5A:
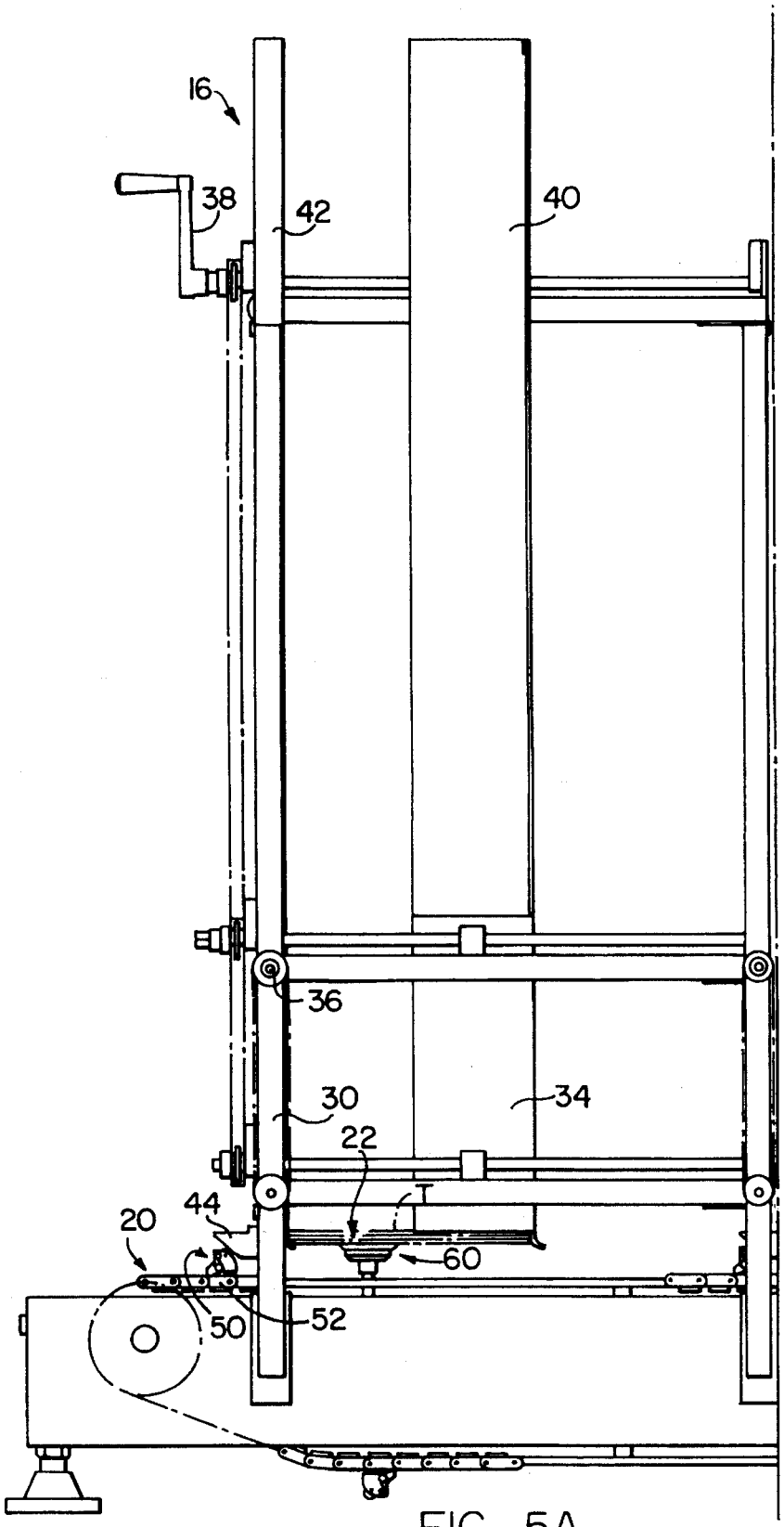
FIG. 5 is side elevational view of the double magazine provided above the tray blank conveyor.
Figure 5B:
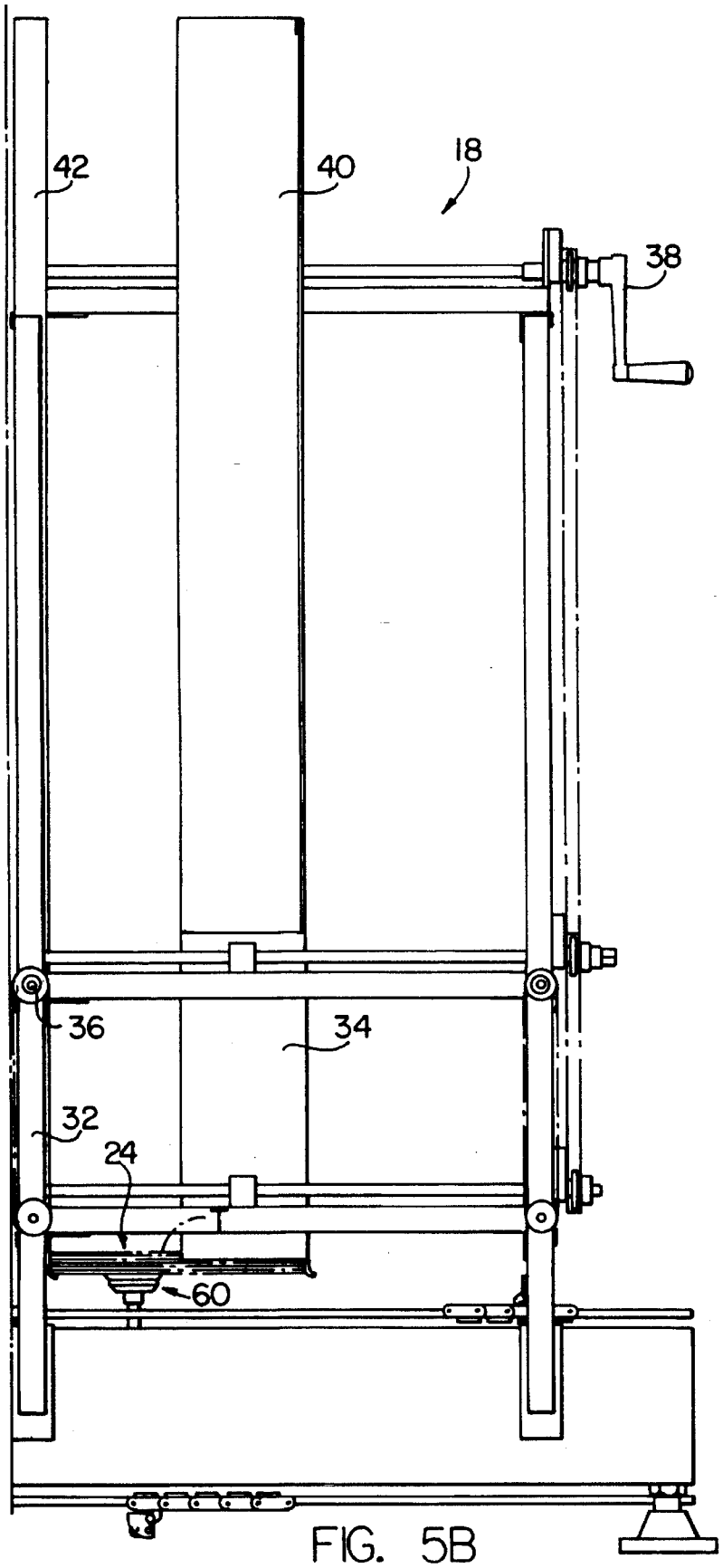

With particular reference to FIGS. 4A, 4B and 4C, it will be apparent that the tray blank conveyor lugs 50 are pivotally supported on the chain 52 so as to be spring loaded in the position shown for in FIGS. 4A and 4C, but so as to be cammed upwardly and rearwardly out of this position by a camming device indicated generally at 44. The camming device 44 is mounted to the frame 30 for the magazine, but is adapted to itself to be shifted laterally from the position shown where it engages the lug 50 to a spaced position laterally of this active position where the lug can pass freely pass the cam 44 without being moved.

FIG. 2 shows the cam 44 and more particularly both cams 44 associated with the lower end of the magazine 16 in two positions one of which is its active position before it engages a cam follower or roller 54 on the lug 50 and another position where the cam 44 is shifted to one side so as to allow the lug 50 to pass freely beneath the magazine 16 without being camreed out of its normal position of FIG. 4A into the open position of FIG. 4B.

Figure 3:
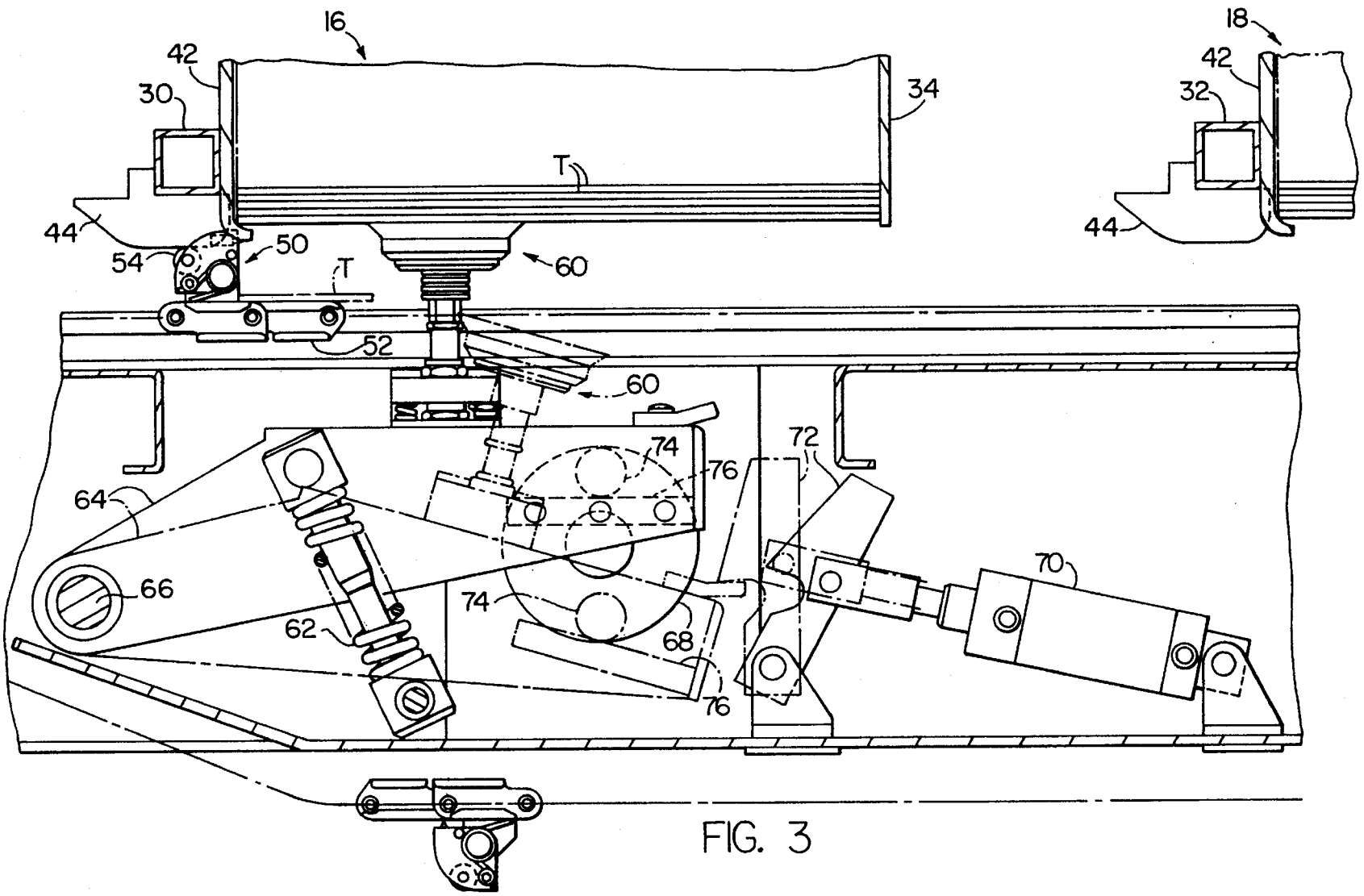
FIG. 3 is a detailed view of the mechanism for drawing tray blanks from one of the two magazines.

Referring now to FIG. 3 in greater detail, the two magazines 16 and 18 are there illustrated schematically in FIG. 3 with the cams 44 provided at the lower end of each magazine on the magazine frames 30, 32. One of these camming devices 44 will be provided in position to engage the cam follow or roller 54 on the lug 50, and hence to open the lug 50 to the position shown for it in FIG. 3 where the lower most blank in the magazine can be drawn downwardly by the suction cup mechanism indicated generally at 60 so that the tray is received on the tray conveyor chains 52. As the lug 50 moves past the camming device 44 shown for example in FIG. 4C, the spring loaded lug will assume the position shown for in FIG. 4C securely grasping or gripping the tray blank T as suggested by the pointed barb 56 provided for this purpose in the lug mechanism 50.

As the tray blank T moves downstream beneath the second magazine 18 it will be essential that the camming device 44 be shifted out of its active position to a position where the lug 50 will pass freely beneath the second magazine 18 without interference. As best shown in FIG. 2, these camming devices 44 are adapted to be shifted between their active and inactive positions by an actuator 58 associated with the shaft 59 on which the camming devices 44 are mounted.

Turning now to a more detailed description for the mechanism for withdrawing the lower most blank from one of the two magazines 16 or 18 as in the case of the magazines two such mechanisms are provided. One of these two mechanisms can be latched in an inactive position by an actuator 70 associated with each. More particularly, the latch 72 is secured to the end of the actuator 70 and is pivoted between the positions shown for it in FIG. 3 for this purpose. A compression spring 62 acts upon a lever 64 journalled in the cross shaft 66, and carries the pair of suction cups 60 that engage the under side of the stack of tray blanks to withdraw the lower most blank as described previously. This lever 64 is operated by a rotating cam 68, the cam 68 having a stub shaft 74 provided in its face as shown in FIG. 3. This stub shaft 74 is adapted to contact the upper surface of a bar 76 provided for this purpose in the free end portion of the lever 64 in order to achieve downward motion of the lever 64 from the solid line position shown forward in FIG. 3 to the phantom line position shown in that view.

We claim:

1. In a packaging machine wherein product groups are packaged in trays as a result of moving the product on a path through a load station at which the product groups are mated with individual trays, the improvement comprising:

at least two tray blank magazines for storing at least two vertical stacks of tray blanks, a tray blank infeed conveyor with an upper run located below said at least two magazines adjacent the bottoms of the tray blanks stacked in said magazines, at least two means for withdrawing the lowermost blank from the bottom of each of said stacked blanks, said means for withdrawing said lowermost blanks provided below the level of said upper run of said tray blank infeed conveyor, and adapted to draw the lowermost blanks downly into the path of said blank infeed conveyor, said blank infeed conveyor having blank engaging lugs provided on said conveyor, each lug including a base portion secured to said conveyor and having a blank pinching portion movably mounted on said base and adapted to move from an inactive position toward an active position pinching the blank between it and the underlying blank conveyor, each said magazine including a frame, and each said magazine frame having a depending device for engaging and camming said blank pinching portion of said lugs such that movement of said lug along said upper run below said magazines causes said blank pinching portion of said lugs to move to said inactive position to permit placement of said blanks provided on said tray blank infeed conveyor and movement past said depending device moves said lug into said active position, said at least two blank withdrawing means operable in timed relationship with movement of the blank conveyor, and means for disabling each of said blank withdrawing means, and means for disabling said depending devices selectively to allow selective operation of one magazine or another to feed blanks onto said blank infeed conveyor.

2. The combination according to claim 1 wherein said depending device is comprised of a cam, and wherein said movable gripping portion of said lugs carry a cam follower roller for engagement with said cam, and said means for disabling said cam comprising a fluid actuator adapted to move said cam out of the path of said movable gripping portion of said lug.

3. The combination according to claim 1 wherein said infeed blank conveyor comprises two side-by-side lug conveyors each of which have lugs as aforesaid, and wherein said means for withdrawing the lowermost blank from each of said stacks of blanks in said magazines is provided between said lug conveyors.

* * * * *